US007556838B2

(12) United States Patent
Maeda et al.

(10) Patent No.: US 7,556,838 B2
(45) Date of Patent: Jul. 7, 2009

(54) SOFT MAGNETIC MATERIAL, POWDER MAGNETIC CORE, METHOD FOR MANUFACTURING SOFT MAGNETIC MATERIAL, AND METHOD FOR MANUFACTURING POWDER MAGNETIC CORE

(75) Inventors: Toru Maeda, Itami (JP); Haruhisa Toyoda, Itami (JP); Koji Mimura, Itami (JP); Yasushi Mochida, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 145 days.

(21) Appl. No.: 11/662,886

(22) PCT Filed: Jul. 19, 2006

(86) PCT No.: PCT/JP2006/314262

§ 371 (c)(1),
(2), (4) Date: Mar. 15, 2007

(87) PCT Pub. No.: WO2007/023627

PCT Pub. Date: Mar. 1, 2007

(65) Prior Publication Data

US 2007/0264521 A1 Nov. 15, 2007

(30) Foreign Application Priority Data

Aug. 25, 2005 (JP) ..... 2005-243888

(51) Int. Cl.
*B05D 3/02* (2006.01)
*B05D 7/00* (2006.01)

(52) U.S. Cl. ..... 427/127; 427/215; 427/314

(58) Field of Classification Search ..... 428/403; 427/212, 127, 215, 226, 314
See application file for complete search history.

(56) References Cited

U.S. PATENT DOCUMENTS

| | | | | |
|---|---|---|---|---|
| 5,252,148 | A * | 10/1993 | Shigeta et al. | 148/307 |
| 5,411,605 | A * | 5/1995 | Omori et al. | 148/113 |
| 6,903,641 | B2 | 6/2005 | Kondo et al. | |
| 2003/0230362 | A1 | 12/2003 | Tajima et al. | |

FOREIGN PATENT DOCUMENTS

| | | | |
|---|---|---|---|
| JP | 35-8048611 | A * | 3/1983 |
| JP | 36-1272346 | A * | 12/1986 |
| JP | 2002-246219 | | 8/2002 |
| JP | 2002-329626 | | 11/2002 |
| JP | 2003-282316 | | 10/2003 |
| JP | 2005-015914 | | 1/2005 |
| JP | 2005-142522 | | 6/2005 |
| JP | 2005-187918 | | 7/2005 |
| JP | 2005-213621 | | 8/2005 |
| JP | 2005-217289 | | 8/2005 |

* cited by examiner

*Primary Examiner*—H. (Holly) T Le
(74) *Attorney, Agent, or Firm*—Global IP Counselors, LLP

(57) ABSTRACT

A soft magnetic material includes a plurality of composite magnetic particles (30) having metallic magnetic particles (10) that are composed of pure iron, and an insulation film (20) that surrounds the surface of the metallic magnetic particles (10), wherein the manganese content of the metallic magnetic particles (10) is 0.013 mass % or less, and is more preferably 0.008 mass % or less. Hysteresis loss can thereby be effectively reduced.

2 Claims, 3 Drawing Sheets

SOFT MAGNETIC MATERIAL, POWDER MAGNETIC CORE, METHOD FOR MANUFACTURING SOFT MAGNETIC MATERIAL, AND METHOD FOR MANUFACTURING POWDER MAGNETIC CORE

TECHNICAL FIELD

The present invention relates to a soft magnetic material, a powder magnetic core, a method for manufacturing a soft magnetic material, and a method for manufacturing a powder magnetic core.

BACKGROUND ART

Soft magnetic materials fabricated by powder metallurgy are used in electric appliances having a solenoid valve, motor, electric circuit, or the like. The soft magnetic material is composed of a plurality of composite magnetic particles, and the composite magnetic particles have metallic magnetic particles composed of pure iron, for example, and an insulation film composed of phosphate, for example, that covers the surface of the particles. Based on a need to improve the energy conversion efficiency, reduce heat output, and achieve other needs in a soft magnetic material, a magnetic property is required that allows a considerable magnetic flux density to be obtained by the application of a weak magnetic field, and a magnetic property is required in which energy loss is low in magnetic flux density fluctuations.

When a powder magnetic core fabricated using this soft magnetic material is used in an alternating magnetic field, energy loss occurs that is referred to as "iron loss." This iron loss is expressed as the sum of hysteresis loss and eddy current loss. Hysteresis loss is a loss of the energy required for varying the magnetic flux density of the soft magnetic material. Eddy current loss is an energy loss produced by eddy current that flows between the metallic magnetic particles constituting the soft magnetic material. Hysteresis loss is proportional to the operating frequency, and eddy current loss is proportional to the square of the operating frequency. For this reason, hysteresis loss is primarily dominant in a low-frequency range, and eddy current loss is dominant in a high-frequency range. A powder magnetic core must have magnetic characteristics that correspond to the generation of minimal iron loss, i.e., high alternating-current magnetic characteristics.

Magnetic domain walls can be moved more easily in order to reduce hysteresis loss in particular among the types of iron loss of a powder magnetic core, and the coercive force Hc of the metallic magnetic particles can be reduced to achieve this. In view of the above, pure iron, which is a material that has a low coercive force Hc, has conventionally been used on a wide scale for metallic magnetic particles. A technique for reducing hysteresis loss is disclosed, for example, in Japanese Laid-Open Patent Application No. 2005-15914 (Patent Document 1), wherein the mass ratio of impurities with respect to the metallic magnetic particles is set to 120 ppm or less by using pure iron as the metallic magnetic particles.

There is also a method for reducing hysteresis loss of the powder-magnetic core in which the metallic magnetic particles are heat-treated before an insulation layer is formed, or the molded article is heat-treated after pressure molding. Using these heat treatments, strain, grain boundaries, and the like present in the metallic magnetic particles can be removed, magnetic domain walls can be moved more easily, and the coercive force Hc of the metallic magnetic particles constituting the soft magnetic material can be reduced. Japanese Laid-open Patent Application 2002-246219 (Patent Document 2), for example, discloses a technique for heating a pressure-molded article in air for 1 hour at a temperature of 320° C. and then further heating the article for 1 hour at a temperature of 240° C.

Patent Document 1: Japanese Laid-Open Patent Application Publication No. 2005-15914

Patent Document 2: Japanese Laid-Open Patent Application Publication No. 2002-246219

DISCLOSURE OF INVENTION

Problems that the Invention is to Solve

In the above-described heat treatments, defects present in the metallic magnetic particles cannot be adequately removed and hysteresis loss cannot be effectively reduced. In the particular case that a pressure-molded article is to be heat-treated, the heat treatment must be carried out at a temperature that is low enough to avoid thermal decomposition of the insulation film on the surface of the metallic magnetic particles. As a result, the heat treatment needs to be carried out over a long period of time in order to sufficiently remove defects present in the metallic magnetic particles, and hysteresis loss cannot be effectively reduced.

Therefore, an object of the present invention is to provide a soft magnetic material, a powder magnetic core, a method for manufacturing a soft magnetic material, and a method for manufacturing a powder magnetic core in which hysteresis loss can be effectively reduced.

Means of Solving the Problems

The soft magnetic material of the present invention comprises a plurality of composite magnetic particles having metallic magnetic particles that are composed of pure iron, and an insulation film that surrounds the surface of the metallic magnetic particles, wherein the manganese content of the metallic magnetic particles is 0.013 mass % or less.

The powder magnetic core according to one aspect of the present invention comprises a plurality of composite magnetic particles having metallic magnetic particles that are composed of pure iron, and an insulation film that surrounds the surface of the metallic magnetic particles, wherein the manganese content of the metallic magnetic particles is 0.013 mass % or less.

The method for manufacturing a soft magnetic material according to the present invention is a method for manufacturing a soft magnetic material composed of a plurality of composite magnetic particles having metallic magnetic particles that are composed of pure iron, and an insulation film that surrounds the surface of the metallic magnetic particles, wherein the method comprises a step for treating the metallic magnetic particles so that the manganese content of the metallic magnetic particles is 0.013 mass % or less; and a step for forming the insulation film on the surface of the metallic magnetic particles.

The method for manufacturing a powder magnetic core in the present invention is a method for manufacturing a powder magnetic core composed of a plurality of composite magnetic particles having metallic magnetic particles that are composed of pure iron, and an insulation film that surrounds the surface of the metallic magnetic particles, wherein the method comprises a step for treating the metallic magnetic particles so that the manganese content of the metallic magnetic particles is 0.013 mass % or less; a step for forming the insulation film on the surface of the metallic magnetic particles and fabricating a soft magnetic material; a step for pressure molding the soft magnetic material and obtaining a molded article; and a step for heat-treating the molded article at a temperature that is equal to or greater than 575° C. but is less than the thermal decomposition temperature of the insulation film.

The present inventors discovered that Mn contained in metallic magnetic particles obstruct the removal of defects by heat treatment. Mn contained in metallic magnetic particles forms an oxide, sulfide, phosphate, or another compound and precipitates along the grain boundaries of Fe (iron). These Mn compounds obstruct the growth of Fe crystal grains due to the pinning effect. As a result, defects present in the metallic magnetic particles and on the grain boundaries in particular cannot be adequately removed.

In view of the above, Mn compounds are prevented from obstructing the growth of Fe crystal grains in the soft magnetic material of the present invention and the powder magnetic core according to one aspect of the invention, as well as the method for manufacturing a soft magnetic material and the method for manufacturing a powder magnetic core according to the present invention. Therefore, the growth of Fe crystal grains is promoted and defects present in the metallic magnetic particles can be adequately removed by heat treatment. As a result, hysteresis loss can be effectively reduced.

In addition to the above, a molded article is heat-treated at a temperature that is equal to or greater than 575° C. but is less than the thermal decomposition temperature of the insulation film in accordance with the method for manufacturing a powder magnetic core of the present invention, whereby the growth of Fe crystal grains can be promoted and hysteresis loss can be effectively reduced.

In the soft magnetic material of the present invention, the Mn content of the metallic magnetic particles is preferably 0.008 mass % or less. Hysteresis loss can thereby be further reduced.

In the soft magnetic material of the present invention, the mean grain size of the metallic magnetic particles is preferably 30 μm or more and 500 μm or less.

The coercive force can be reduced by setting the mean grain size of metallic magnetic particles to be 30 μm or more. Eddy current loss can be reduced by setting the mean grain size to be 500 μm or less. A reduction in the compressibility of the mixed powder during pressure molding can also be reduced. A reduction in the density of the molded article obtained by pressure molding is thereby deterred, thus avoiding a situation in which the article is made more difficult to handle.

In the soft magnetic material of the present invention, the mean thickness of the insulation film is preferably 10 nm or more and 1 μm or less.

Energy loss due to eddy current can be effectively reduced by setting the mean thickness of the insulation film to be 10 nm or more. The insulation film can be prevented from shear-fracturing during pressure molding by setting the mean thickness of the insulation film to be 1 μm or less. Since the ratio of insulation film to the soft magnetic material is not excessive, it is possible to prevent a marked reduction in the magnetic flux density of the powder magnetic core obtained by press-molding the soft magnetic material.

In the soft magnetic material of the present invention, the insulation film preferably comprises at least one compound selected from the group consisting of iron phosphate, aluminum phosphate, silicon phosphate, magnesium phosphate, calcium phosphate, yttrium phosphate, zirconium phosphate, and silicon-containing organic compounds.

The above-described materials have excellent heat resistance and deformation properties during molding, and are therefore suitable as materials that constitute the insulation film.

The powder magnetic core according to another aspect of the present invention is manufactured using the above-described soft magnetic material.

In the powder magnetic core according to the other aspect of the present invention, the coercive force in a maximum applied magnetic field of 8,000 A/m is preferably 120 A/m or less, and the iron loss at a maximum magnetic flux density of 1.0 T and a frequency of 1,000 Hz is preferably 75 W/kg or less.

As used in the present specification, the term "pure iron" refers to an Fe ratio of 99.5 mass % or higher, the remaining 0.5 mass % or less being impurity content.

Effects Of The Invention

Hysteresis loss can be effectively reduced with the soft magnetic material, the powder magnetic core, the method for manufacturing the soft magnetic material, and the method for manufacturing a powder magnetic core according to the present invention.

DESCRIPTION OF REFERENCE NUMERALS

10 metallic magnetic particles
20 insulation film
30 composite magnetic particles
40 resin

BEST MODE FOR CARRYING OUT THE INVENTION

An embodiment of the present invention is described below with reference to the diagrams.

Figure 1:
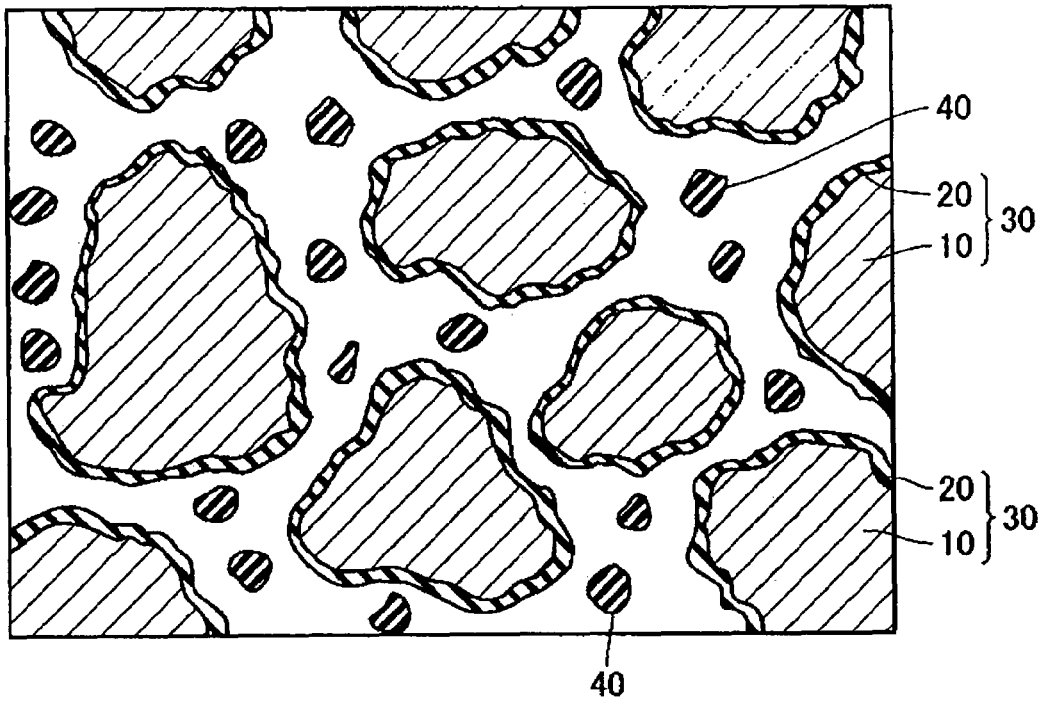
[FIG. 1] A diagram that schematically shows the soft magnetic material according to the first embodiment of the present invention.

FIG. 1 is a diagram that schematically shows the soft magnetic material according to the first embodiment of the present invention. In FIG. 1, the soft magnetic material in the present embodiment comprises a plurality of composite magnetic particles 30 having metallic magnetic particles 10 that are composed of pure iron, and an insulation film 20 that surrounds the surface of the metallic magnetic particles 10. The soft magnetic material may also include a resin 40, a lubricant (not shown), and other components in addition to the composite magnetic particles 30.

Figure 2:
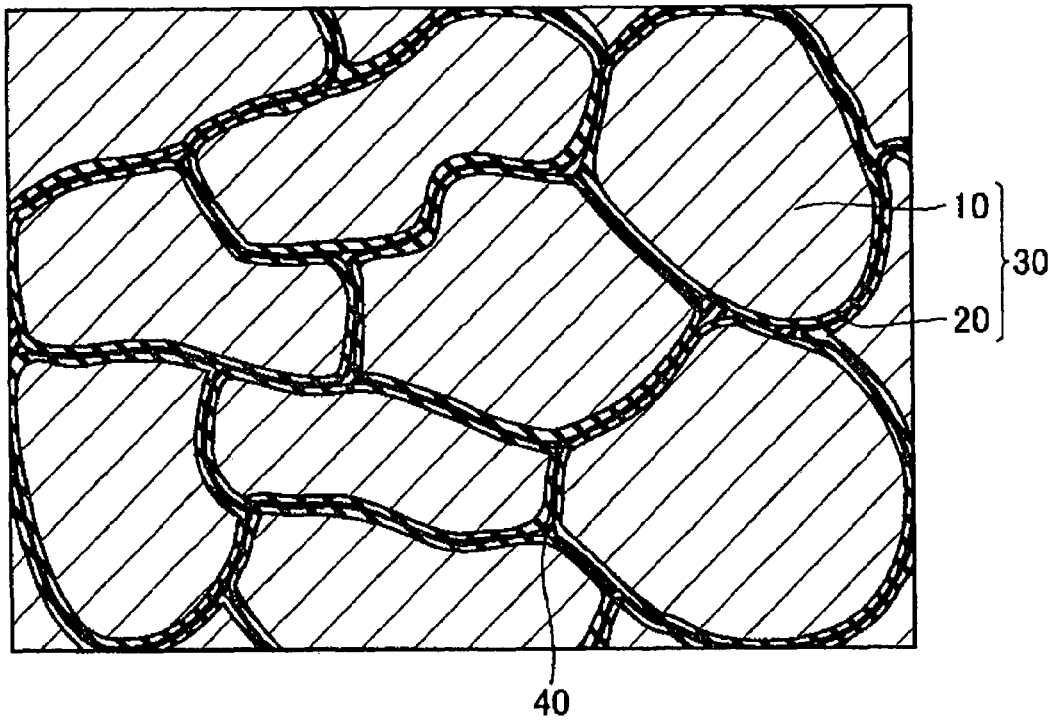
[FIG. 2] An enlarged cross-sectional view of the powder magnetic core according to the first embodiment of the present invention.

FIG. 2 is an enlarged cross-sectional view of the powder magnetic core according to the first embodiment of the present invention. The powder magnetic core in FIG. 2 is manufactured by press-molding and heat-treating the soft magnetic material in FIG. 1. The composite magnetic particles 30 in the powder magnetic core in the present embodiment are bonded together by an insulation film 40, or bonded together by causing the concavities and convexities of the composite magnetic particles 30 to mesh together. The insulation film 40 is one in which the resin 40 or the like contained in the soft magnetic material is changed during heat treatment.

In the soft magnetic material and powder magnetic core of the present embodiment, the Mn content of the metallic magnetic particles 10 is 0.013 mass % or less, and is preferably 0.008 mass % or less. The Mn content can be measured by inductively coupled plasma/atomic emission spectroscopy (ICP-AES). In this case, the insulation film and resin are removed by a suitable pulverization (in the case of a powder magnetic core) and chemical treatment to perform the measurement.

The mean grain size of the metallic magnetic particles 10 is preferably 30 μm or more and 500 μm or less. The coercive force can be reduced by setting the mean grain size of metallic magnetic particles 10 to be 30 μm or more. Eddy current loss can be reduced by setting the mean grain size to be 500 μm or less. A reduction in the compressibility of the mixed powder during pressure molding can also be reduced. A reduction in the density of the molded article obtained by pressure molding is thereby deterred, thus avoiding a situation in which the article is made more difficult to handle.

As used herein, the mean grain size of the metallic magnetic particles 10 refers to a grain size in which the sum of the masses from the smallest grain sizes has reached 50% of the total mass, i.e., 50% grain size in a histogram of the grain sizes.

The insulation film 20 functions as an insulation layer between the metallic magnetic particles 10. The electrical resistivity ρ of the powder magnetic core obtained by press-molding the soft magnetic material can be increased by using the insulation film 20 to coat the metallic magnetic particles 10. Eddy current can thereby be prevented from flowing between the metallic magnetic particles 10, and the eddy current loss of the powder magnetic core can be reduced.

The mean thickness of the insulation film 20 is preferably 10 nm or more and 1 μm or less. Energy loss due to eddy current can be effectively reduced by setting the mean thickness of the insulation film 20 to be 10 nm or more. The insulation film 20 can be prevented from shear-fracturing during pressure molding by setting the mean thickness of the insulation film to be 1 μm or less. Since the ratio of insulation film 20 to the soft magnetic material is not excessive, it is possible to prevent a marked reduction in the magnetic flux density of the powder magnetic core obtained by press-molding the soft magnetic material.

The insulation film 20 comprises iron phosphate, aluminum phosphate, silicon phosphate, magnesium phosphate, calcium phosphate, yttrium phosphate, zirconium phosphate, or a silicon-based organic compound.

Examples of the resin 40 include polyethylene resin, silicone resin, polyamide resin, polyimide resin, polyamide-imide resin, epoxy resin, phenol resin, acrylic resin, and fluororesin.

Figure 3:
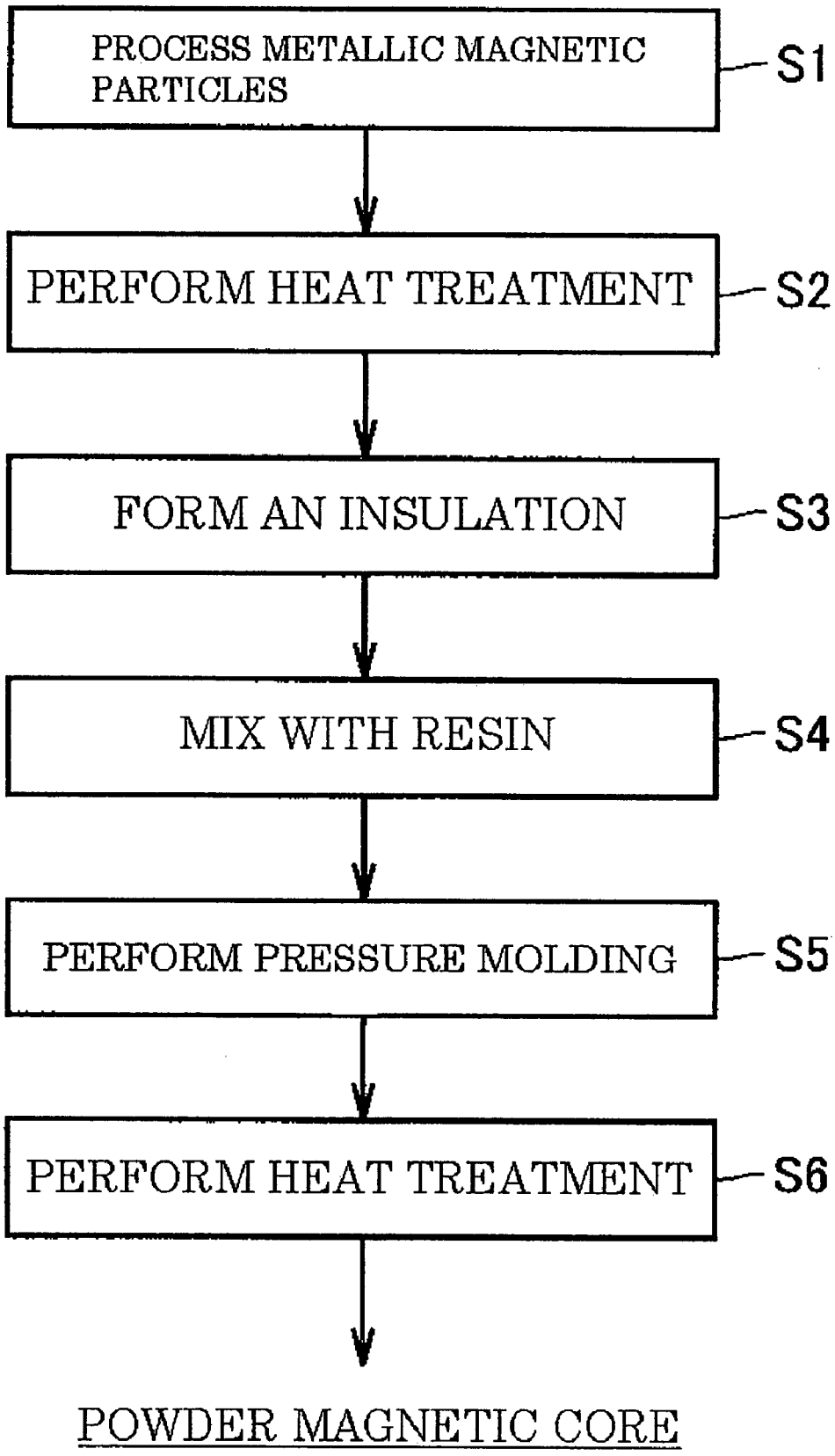
[FIG. 3] A diagram showing, as a sequence of steps, the method for manufacturing a powder magnetic core according to the first embodiment of the present invention.

Methods for manufacturing the soft magnetic material shown in FIG. 1 and the powder magnetic core shown in FIG. 2 are described next. FIG. 3 is a diagram showing, as a sequence of steps, the method for manufacturing a powder magnetic core according to the first embodiment of the present invention.

First, in FIG. 3, metallic magnetic particles are treated so that the Mn content of the metallic magnetic particles is brought to 0.013 mass % or less, or more preferably 0.008 mass % or less (step S1). Specifically, highly pure electrolytic iron in which the Mn content is 0.013 mass % or less is prepared, and the highly pure electrolytic iron is pulverized by atomization to obtain metallic magnetic particles 10.

In addition to the method for obtaining metallic magnetic particles from highly pure electrolytic iron, there is also a method in which the Mn content of the metallic magnetic particles may be reduced and set at a level of 0.013 mass % or less by heating metallic magnetic particles having an Mn content greater than 0.013 mass % in an Mn reducing atmosphere. The reductive reactions expressed by formulas (1) and (2) below are typically brought about and Mn is removed from the metallic magnetic particles as MnS and $MnCl_2$ when, for example, a suitable amount of FeS powder and $FeCl_3$ powder is adsorbed onto the surface of the metallic magnetic particles having an Mn content greater than 0.013 mass %, and the particles are heat-treated (pre-annealed) in a reducing atmosphere (e.g., hydrogen atmosphere) at a temperature that is 1,000° C. or higher and 50° C. less than the melting point of iron. The heat treatment temperature is preferably a temperature that is lower than the temperature at which the metallic magnetic particles sinter together and cannot disintegrate.

$$\text{Mn(in Fe)}+\text{FeS}\rightarrow\text{Fe}+\text{MnS} \quad (1)$$

$$3\text{Mn(in Fe)}+2\text{FeCl}_3\rightarrow 2\text{Fe}+3\text{MnCl}_2 \quad (2)$$

The element combined with a Fe compound and used for reducing Mn may be an element other than S and Cl, as long as the element for which the free energy of producing a compound with Mn is less than the free energy of producing a compound with Fe.

Next, the metallic magnetic particles 10 are heat-treated at a temperature of 400° C. or higher and less than 900° C., for example (step S2). The heat treatment temperature is even more preferably 700° C. or higher and less than 900° C. Strain, and numerous other defects present at the crystal grain boundaries inside the metallic magnetic particles 10 prior to heat treatment are due to heat stress produced during atomizing treatment and to stress produced by disintegration after the above-described Mn reducing treatment. In view of this situation, these defects can be reduced by heat-treating the metallic magnetic particles 10. In the present embodiment, since the Mn content of the metallic magnetic particles 10 is 0.013 mass % or less, Mn compounds do not obstruct the growth of Fe crystal grains, and defects present in the metallic magnetic particles 10 can be adequately removed by heat treatment. This heat treatment may be omitted.

Next, an insulation film 20 is formed on the surface of each of the metallic magnetic particles 10 (step S3). A plurality of composite magnetic particles 30 is obtained by this step. The insulation film 20 can be formed by subjecting the metallic magnetic particles 10 to phosphate conversion treatment, for example. Examples of an insulation film 20 formed by phosphate conversion treatment include iron phosphates composed of phosphorus and iron, as well as aluminum phosphate, silicon phosphate, magnesium phosphate, calcium phosphate, yttrium phosphate, and zirconium phosphate. Solvent blowing or sol-gel treatment using a precursor can be used to form these phosphate insulation films. Also, an insulation film 20 composed of a silicon-based organic compound may be formed. Wet coating treatment using an organic solvent, direct-coating treatment using a mixer, and other coating treatments may also be used.

An oxide-containing insulation film 20 may also be formed. Examples of oxide insulators that can be used as the oxide-containing insulation film 20 include silicon oxide, titanium oxide, aluminum oxide, and zirconium oxide. Solvent blowing or sol-gel treatment using a precursor can be used to form these insulation films.

Next, resin 40 is mixed with the composite magnetic particles 30 (step S4). The method of mixing the components is not particularly limited, and examples of mixing methods include mechanical alloying; mixing by using a vibration ball mill or planetary ball mill; and using methods such as mechanofusion, co-precipitation, chemical vapor deposition (CVD), physical vapor deposition (PVD), plating; sputtering, vapor deposition, or the sol-gel method. A lubricant may also be mixed with the particles. The mixing step may be omitted.

The soft magnetic material of the present embodiment shown in FIG. 1 can be obtained by the above-described steps. The following steps are further carried out when the powder magnetic core shown in FIG. 2 is manufactured.

The resulting soft magnetic material powder is subsequently placed in a mold and pressure-molded using pressure in a range of, e.g., 390 (MPa) to 1,500 (MPa) (step S5). A molded article in which the soft magnetic material is compacted can thereby be obtained. The atmosphere for pressure molding is preferably an inert gas atmosphere or a reduced-pressure atmosphere. In this case, mixed powder can be prevented from being oxidized by oxygen in the atmosphere.

Next, the molded article obtained by pressure molding is heat-treated at a temperature that is, e.g., equal to or greater than 575° C. but is less than the thermal decomposition temperature of the insulation film 20 (step S6). Since a large number of defects are generated inside the molded article produced by pressure molding, these defects can be removed by heat treatment. In the present embodiment, the Mn content of the metallic magnetic particles 10 is 0.013 mass % or less. Therefore, Mn compounds do not obstruct the growth of Fe crystal grains, and defects present in the metallic magnetic particles 10 can be adequately removed by heat treatment. In particular, the recrystallization of Fe can be promoted and grain boundaries can be reduced by conducting a heat treatment at a temperature of 575° C. or higher. The powder magnetic core of the present embodiment shown in FIG. 2 is completed by the above-described steps. In accordance with present embodiment, a powder magnetic core can be obtained in which the coercive force in a maximum applied magnetic field of 8,000 A/m is 120 A/m or less, and the iron loss at a maximum magnetic flux density of 1.0 T and a frequency of 1,000 Hz is 75 W/kg or less.

In the soft magnetic material, powder magnetic core, method for manufacturing a soft magnetic material, and method for manufacturing a powder magnetic core of the present embodiment, the growth of Fe crystal grains can be promoted and defects in the metallic magnetic particles 10 can be adequately removed with the aid of a heat treatment by setting the Mn content of the metallic magnetic particles 10 to be 0.013 mass % or less. As a result, hysteresis loss can be effectively reduced.

EXAMPLE 1

In the present example, the effect of setting the Mn content of the metallic magnetic particles to be 0.013 mass % or less was studied. First, powder magnetic cores of the present invention examples A to C and the comparative examples D to F of the present invention were manufactured using the following method.

Present Invention Example A

Pure iron was pulverized by gas atomization and a plurality of metallic magnetic particles was prepared without any particular addition of new Mn. The metallic magnetic particles were subsequently immersed in an aqueous solution of aluminum phosphate, and an insulation film composed of aluminum phosphate was formed on the surface of the metallic magnetic particles. The metallic magnetic particles thus covered by the insulation film and a silicone resin were mixed in xylene and heat-treated for 1 hour at a temperature of 150° C. in atmosphere to heat-cure the silicone resin. A soft magnetic material was obtained by the above process. Next, the xylene was dried and volatilized, and the soft magnetic material was pressure-molded at a press bearing of 1,280 MPa to fabricate molded articles. The molded articles were heat-treated for 1 hour in an atmosphere of flowing nitrogen at different temperatures ranging from 450° C. to 625° C. to thereby obtain a powder magnetic core.

Present Invention Example B

Pure iron having an Mn content of 0.005 mass % was pulverized by gas atomization to prepare metallic magnetic particles. A powder magnetic core was thereafter obtained using the same manufacturing method as in the present invention example A.

Present Invention Example C

Pure iron having an Mn content of 0.01 mass % was pulverized by gas atomization to prepare metallic magnetic particles. A powder magnetic core was thereafter obtained using the same manufacturing method as in the present invention example A.

Comparative Example D

Pure iron having an Mn content of 0.02 mass % was pulverized by gas atomization to prepare metallic magnetic particles. A powder magnetic core was thereafter obtained using the same manufacturing method as in the present invention example A.

Comparative Example E

Pure iron having an Mn content of 0.05 mass % was pulverized by gas atomization to prepare metallic magnetic particles. A powder magnetic core was thereafter obtained using the same manufacturing method as in the present invention example A.

Comparative Example F

Pure iron having an Mn content of 0.10 mass % was pulverized by gas atomization to prepare metallic magnetic particles. A powder magnetic core was thereafter obtained using the same manufacturing method as in the present invention example A.

The powder magnetic cores thus obtained were wound on a ringed molded article (heat-treated) having an outside diameter of 34 mm, an inside diameter of 20 mm, and a thickness of 5 mm so that the primary winding had 300 turns and the secondary winding had 20 turns, yielding samples for measuring the magnetic characteristics. The coercive force of these samples was measured in a maximum applied magnetic field of 8,000 A/m by using an direct current BH curve tracer. Hysteresis loss and iron loss were also measured using the direct orrected.current BH curve tracer. In the measurement of the iron loss, the excitation magnetic flux density was 10 kG (+1 T (Tesla)) and the measurement frequency was 1,000

Hz. Hysteresis loss was calculated from the iron loss. This calculation was carried out by fitting the frequency curve of the iron loss in accordance with the least-squares method with the aid of the following three formulas, and the hysteresis loss coefficient and overcurrent loss coefficient were calculated.

(Iron loss)=(Hysteresis loss coefficient)×(Frequency)+(Eddy current loss coefficient)×(Frequency)$^2$ (Hysteresis loss)=(Hysteresis loss coefficient)×(Frequency)

(Eddy current loss)=(Eddy current loss coefficient)×(Frequency)$^2$

Figure 4:
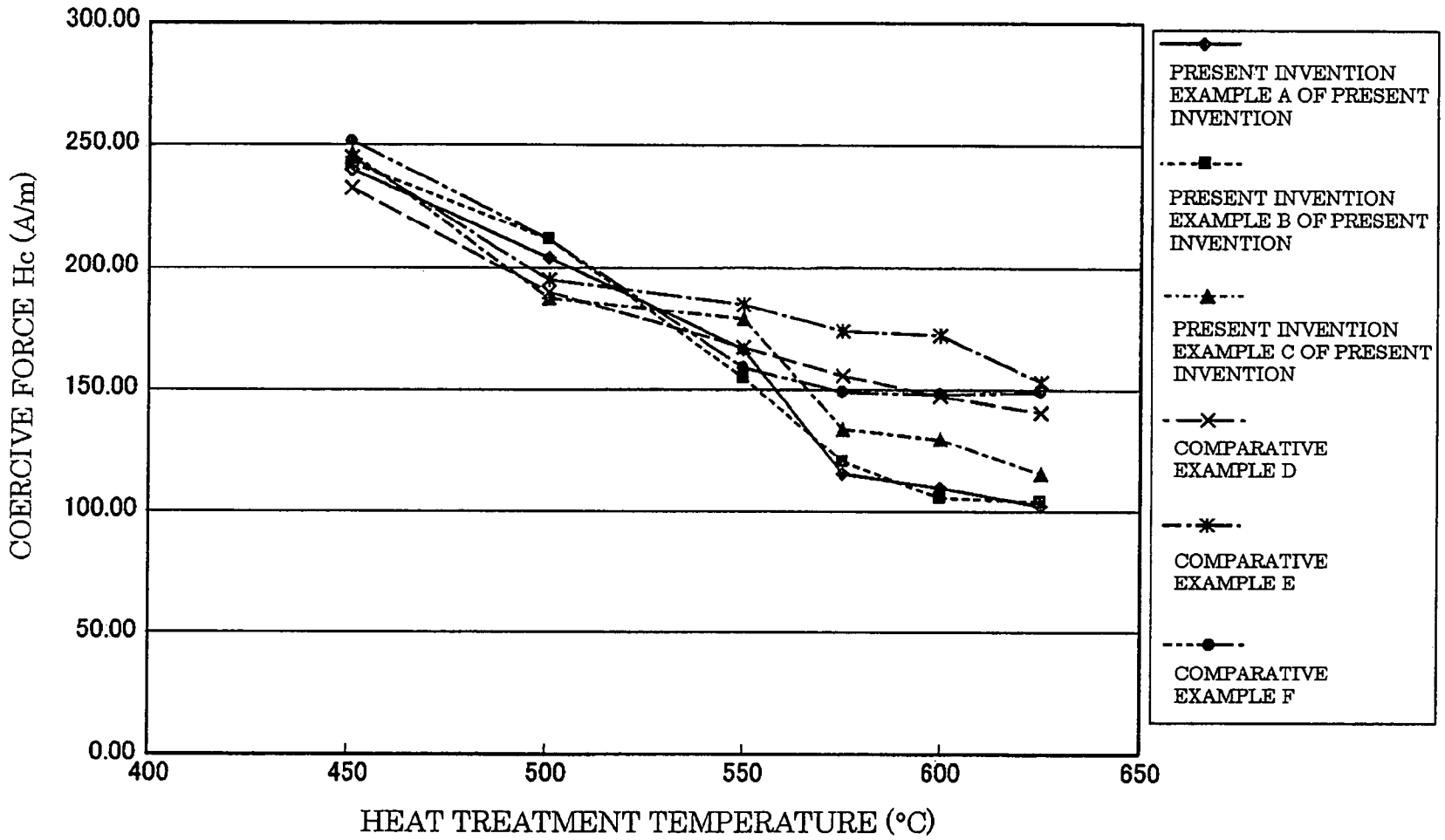
[FIG. 4] A diagram showing the relationship between the heat treatment temperature and the coercive force Hc in example 1 of the present invention.

After taking measurements, the powder magnetic cores were dissolved in acid and filtered to extract only the metallic magnetic particles, and the Mn content of the metallic magnetic particles was measured again. The Mn content of the metallic magnetic particles was 0.002 mass % in the present invention example A, 0.008 mass % in the present invention example B, 0.013 mass % in the present invention example C, 0.036 mass % in the comparative example D, 0.07 mass % in the comparative example E, and 0.12 mass % in the comparative example F. The measurements of the coercive force Hc, iron loss $W_{10/1000}$, and hysteresis loss $Wh_{10/1000}$ are shown in TABLE 1. FIG. 4 shows the relationship between the heat treatment temperature and the coercive force Hc.

When the heat treatment was carried out at 575° C. or higher, the coercive force Hc of the present invention examples A to C was markedly reduced, as shown in TABLE 1 and FIG. 4. Specifically, the coercive force Hc was $1.41\times10^2$ A/m or higher in the comparative examples D to F, and $1.34\times10^2$ to $1.03\times10^2$ A/m in the present invention examples A to C. The coercive force Hc in the present invention examples A and B was $1.21\times10^2$ or less, showing particularly marked reduction. Also, when the heat treatment was carried out at 575° C. or higher, the hysteresis loss $Wh_{10/1000}$ of the present invention examples A to C was markedly reduced in conjunction with the reduction in coercive force Hc. Specifically, the hysteresis loss was 46 to 58 W/kg or higher in the present invention examples A to C, but was 60 W/kg or higher in the comparative examples D to F. In samples 4, 5, and 11 of the present invention examples A to C, the coercive force Hc was 120 A/m or less, and the iron loss was 75 W/kg or less.

The present inventors believe the following to be the reasons that hysteresis loss in the present invention examples A to C was reduced when the heat treatment was carried out at 575° C. or higher. Although strain. inside the metallic magnetic particles was removed when the heat treatment was carried out at less than 575° C., the Fe crystal grains did not exhibit much growth. For this reason, when the heat treatment was carried out at less than 575° C., a clear difference was not

TABLE 1

| Sample | Mn content (wt %) of metallic magnetic particles | Heat treatment temperature (° C.) | Coercive force Hc (A/m) | Iron loss $W_{10/1000}$ (W/kg) | Hysteresis loss $Wh_{10/1000}$ (W/kg) | Remarks |
|---|---|---|---|---|---|---|
| 1 | 0.002 | 450 | $2.40\times10^2$ | 128 | 96 | Present |
| 2 | | 500 | $2.04\times10^2$ | 94 | 77 | Invention |
| 3 | | 550 | $1.66\times10^2$ | 93 | 66 | Example A |
| 4 | | 575 | $1.16\times10^2$ | 70 | 52 | |
| 5 | | 600 | $1.10\times10^2$ | 71 | 49 | |
| 6 | | 625 | $1.03\times10^2$ | 119 | 46 | |
| 7 | 0.008 | 450 | $2.43\times10^2$ | 119 | 100 | Present |
| 8 | | 500 | $2.12\times10^2$ | 101 | 82 | Invention |
| 9 | | 550 | $1.55\times10^2$ | 86 | 65 | Example B |
| 10 | | 575 | $1.21\times10^2$ | 74 | 55 | |
| 11 | | 600 | $1.06\times10^2$ | 75 | 50 | |
| 12 | | 625 | $1.04\times10^2$ | 103 | 47 | |
| 13 | 0.013 | 450 | $2.47\times10^2$ | 128 | 103 | Present |
| 14 | | 500 | $1.88\times10^2$ | 96 | 75 | Invention |
| 15 | | 550 | $1.79\times10^2$ | 93 | 71 | Example C |
| 16 | | 575 | $1.34\times10^2$ | 78 | 58 | |
| 17 | | 600 | $1.30\times10^2$ | 75 | 54 | |
| 18 | | 625 | $1.16\times10^2$ | 89 | 49 | |
| 19 | 0.036 | 450 | $2.32\times10^2$ | 116 | 93 | Comparative |
| 20 | | 500 | $1.90\times10^2$ | 97 | 78 | Example D |
| 21 | | 550 | $1.67\times10^2$ | 86 | 68 | |
| 22 | | 575 | $1.56\times10^2$ | 90 | 66 | |
| 23 | | 600 | $1.47\times10^2$ | 115 | 62 | |
| 24 | | 625 | $1.41\times10^2$ | Excessive iron loss | Excessive iron loss | |
| 25 | 0.07 | 450 | $2.45\times10^2$ | 126 | 105 | Comparative |
| 26 | | 500 | $1.95\times10^2$ | 103 | 80 | Example E |
| 27 | | 550 | $1.85\times10^2$ | 99 | 76 | |
| 28 | | 575 | $1.74\times10^2$ | 93 | 67 | |
| 29 | | 600 | $1.73\times10^2$ | 96 | 63 | |
| 30 | | 625 | $1.54\times10^2$ | Excessive iron loss | Excessive iron loss | |
| 31 | 0.12 | 450 | $2.51\times10^2$ | 112 | 89 | Comparative |
| 32 | | 500 | $2.12\times10^2$ | 106 | 83 | Example F |
| 33 | | 550 | $1.59\times10^2$ | 90 | 68 | |
| 34 | | 575 | $1.49\times10^2$ | 88 | 62 | |
| 35 | | 600 | $1.48\times10^2$ | 136 | 60 | |
| 36 | | 625 | $1.49\times10^2$ | Excessive iron loss | Excessive iron loss | |

observed between the results of the present invention examples A to C and the results of the comparative examples D to F. When the heat treatment was carried out at 575° C. or higher, the strain in the metallic magnetic particles was removed and Fe crystal grain growth was exhibited. Therefore, the growth of Fe crystal grains was promoted and grain boundaries were adequately removed in the present invention examples A to C. As a result, better results were obtained in the present invention examples A to C in comparison with the results of the comparative examples D to F. It is apparent from the above that hysteresis loss can be effectively reduced in accordance with the present invention.

The embodiment and examples disclosed above are examples in all respects, and no limitations should be implied thereby. The scope of the present invention is not limited to the embodiment and examples above. The scope is set forth in the claims and includes all revisions and modifications within the scope and equivalent meanings of the claims.

INDUSTRIAL APPLICABILITY

The soft magnetic material, powder magnetic core, method for manufacturing soft magnetic material, and method for manufacturing a powder magnetic core according to the present invention may be used, e.g., in motor cores, solenoid valves, reactors, and general electromagnetic components.

The invention claimed is:

1. A method for manufacturing a soft magnetic material composed of a plurality of composite magnetic particles having metallic magnetic particles that are composed of pure iron, and an insulation film that surrounds the surface of the metallic magnetic particles, the method comprising:

heating the metallic magnetic particles having a manganese content of greater than 0.013 mass % in a manganese reducing atmosphere so that the manganese content of the metallic magnetic particles becomes 0.013 mass % or less with an impurity content remaining at greater than 0.013 mass %; and forming the insulation film on the surface of the metallic magnetic particles.

2. A method for manufacturing a powder magnetic core composed of a plurality of composite magnetic particles having metallic magnetic particles that are composed of pure iron, and an insulation film that surrounds the surface of the metallic magnetic particles, the method comprising:

heating the metallic magnetic particles in a manganese reducing atmosphere so that the manganese content of the metallic magnetic particles becomes 0.013 mass % or less with an impurity content remaining at greater than 0.013 mass %;

forming the insulation film on the surface of the metallic magnetic particles and fabricating a soft magnetic material;

pressure molding the soft magnetic material and obtaining a molded article; and heat-treating the molded article at a temperature that is equal to or greater than 575.degree. C. but is less than the thermal decomposition temperature of the insulation film.

* * * * *